US007403178B2

(12) United States Patent
Yang et al.

(10) Patent No.: US 7,403,178 B2
(45) Date of Patent: Jul. 22, 2008

(54) SOURCES DRIVER CIRCUIT FOR ACTIVE MATRIX ELECTROLUMINESCENT DISPLAY AND DRIVING METHOD THEREOF

(75) Inventors: Yil Suk Yang, Daejeon-Shi (KR); Jong Dae Kim, Daejeon-Shi (KR); Dae Woo Lee, Daejeon-Shi (KR); Tae Moon Roh, Daejeon-Shi (KR); Il Yong Park, Daejeon-Shi (KR); Sung Ku Kwon, Daejeon-Shi (KR); Byoung Gon Yu, Daejeon-Shi (KR)

(73) Assignee: Electronics and Telecommunications Research Institute, Daejeon-shi (KR)

( * ) Notice: Subject to any disclaimer, the term of this patent is extended or adjusted under 35 U.S.C. 154(b) by 617 days.

(21) Appl. No.: 10/817,838

(22) Filed: Apr. 6, 2004

(65) Prior Publication Data

US 2005/0140595 A1 Jun. 30, 2005

(30) Foreign Application Priority Data

Dec. 24, 2003 (KR) ..... 10-2003-0096035

(51) Int. Cl.
*G09G 3/30* (2006.01)
*G09G 3/20* (2006.01)
*G09G 3/22* (2006.01)

(52) U.S. Cl. ..... 345/76; 345/75.2; 345/74.1

(58) Field of Classification Search ..... 345/156, 345/75.2, 74.1, 76
See application file for complete search history.

(56) References Cited

U.S. PATENT DOCUMENTS

| | | | | |
|---|---|---|---|---|
| 5,670,979 | A * | 9/1997 | Huq et al. | 345/100 |
| 6,278,423 | B1 | 8/2001 | Wald et al. | |
| 6,320,565 | B1 * | 11/2001 | Albu et al. | 345/98 |
| 6,348,785 | B2 * | 2/2002 | Wohlfarth | 324/73.1 |
| 6,369,783 | B1 * | 4/2002 | Kwon et al. | 345/75.2 |
| 6,417,825 | B1 | 7/2002 | Stewart et al. | |
| 6,462,728 | B1 * | 10/2002 | Janssen et al. | 345/100 |
| 6,469,687 | B1 * | 10/2002 | Janssen | 345/94 |
| 7,078,957 | B2 * | 7/2006 | Kim et al. | 327/538 |
| 2002/0030653 | A1 * | 3/2002 | Cairns et al. | 345/87 |
| 2004/0090402 | A1 * | 5/2004 | Cheng | 345/77 |

OTHER PUBLICATIONS

L. Arbuthnot, et al.: "*Advances in grayshade performance of active matrix electroluminescent (AMEL) microdisplays*"; Planar Systems, Inc.; pp. 1-8.

* cited by examiner

*Primary Examiner*—Amare Mengistu
*Assistant Examiner*—Elijah M Sheets
(74) *Attorney, Agent, or Firm*—Lowe Hauptman Ham & Berner LLP

(57) ABSTRACT

Provided is a source driver circuit for an active matrix electroluminescent (EL) display including a digital-to-analog converter/ramp circuit for converting a digital signal into an analog signal, and generating a ramp signal in this process, simultaneously, whereby high degree of integration would be possible since a conventional complicated circuit is not required and gray scale with the high characteristic can be implanted, regardless of a change of a temperature or a threshold voltage.

7 Claims, 5 Drawing Sheets

SOURCES DRIVER CIRCUIT FOR ACTIVE MATRIX ELECTROLUMINESCENT DISPLAY AND DRIVING METHOD THEREOF

BACKGROUND

1. Field of the Invention

The present invention relates to a source driver integrated chip (IC) for an active matrix electroluminescent display and, more particularly, to a source driver circuit for an active matrix display including a digital-to-analog converter/ramp circuit, in which a digital signal is converted into an analog signal and, at this time, a ramp signal is generated, simultaneously.

2. Discussion of Related Art

Generally, a source driver IC for a flat panel display has been known that provides a data to a panel for one fame time. The source driver IC is the same as a data driver IC or a column driver IC. There are two driving methods of the source driver IC: a passive matrix (PM) and an active matrix (AM). The active matrix comprises a thin film transistor (TFT) serving as a switch in each pixel, and a storage capacitor for storing data. And, it is divided into a voltage driven active matrix and a current driven active matrix. In the case of the voltage driven active matrix, a final output becomes a voltage. On the other hand, the final output becomes a current in the case of the current driven active matrix. It depends on a display device, and an inorganic electroluminescent (EL) is a voltage driven display device.

Hereinafter, a source driver circuit for an active matrix EL display, according to a prior art, will be explained with reference to FIG. 1.

FIG. 1 is a detailed block diagram of a source driver circuit for an active matrix EL display, according to a prior art. The source driver circuit 1 for the active matrix EL display comprises a shift register circuit 10, a data latch circuit 20, a line latch circuit 30, a digital-to-analog converter circuit (voltage type DAC) 40, an analog output buffer circuit 50, and a ramp circuit 60.

The shift register circuit 10 receives a main clock CLK signal and a left/right (L/R) signal for determining a direction, and generates an enable signal that sequentially stores a data in the line latch circuit 30, and the line latch circuit 30 works as a latch for storing the data. The line latch circuit 30 stores the data sequentially by the enable signal of the shift register circuit 10 for one line time, and then, transfers the data stored by a LOAD signal to the digital-to-analog converter circuit (D/A converter circuit) 40 in parallel, at a time. At this time, a new data is stored in the line latch circuit 30.

The D/A converter circuit 40 converts a digital signal into an analog signal and inputs it to the output buffer circuit 50.

In the ramp circuit 60, a reference voltage having a sawtooth waveform should have an excellent linearity, since it has to be equal to the input analog signal. However, it is difficult to obtain the same properties in the ramp circuit 60 and the D/A converter circuit 40 together, since they are separated each other, and thus, a temperature or a threshold voltage changes. The ramp circuit 60 is synchronized to a frame clock and has the sawtooth waveform.

As described above, in the source driver circuit for the active matrix display according to the prior art, an excellent ramp circuit is required to implant full color. Thus, there have been demerits that the high performance ramp circuit has a complex architecture, and the sawtooth waveform having the same property as that of the D/A converter cannot be fabricated due to a change of a temperature or a threshold voltage, since the ramp circuit is separated from the D/A converter circuit.

SUMMARY OF THE INVENTION

The present invention is contrived to solve the problems, and it is directed to a source driver circuit for an active matrix electroluminescent (EL) display in which the ramp circuit and the D/A converter circuit are formed together. Therefore, it is possible to form the sawtooth waveform exactly.

In addition, the present invention provides a source driver circuit that a conventional complicated circuit is not required and gray scale with the high characteristic can be implanted, regardless of a change of a temperature or a threshold voltage.

One aspect of the present invention is to provide a source driver circuit for an active matrix EL display, comprising: a shift register circuit for receiving a main clock signal and generating an enable signal for sequentially storing a digital data; a line latch circuit for sequentially storing the data by the enable signal, and outputting the stored digital data, in parallel; a digital-to-analog converter/ramp circuit for converting the digital signal outputted from the line latch circuit to an analog signal, and at this time, generating a ramp signal, simultaneously; and an output buffer circuit for inputting the converted analog data.

Here, the digital-to-analog converter/ramp circuit comprises a digital-to-analog converter unit for converting a digital data into an analog data, and a ramp switch unit for controlling each node output in the digital-to-analog converter unit. Further, in the digital-to-analog converter/ramp circuit, Binary-Weighted Resistor digital-to-analog converter (DAC), R-2R-Based DAC, Switch-Capacitor DAC, or Current-Mode DAC is employed for a digital-to-analog conversion.

In a preferred embodiment of the present invention, the digital-to-analog converter/ramp circuit may further comprise: a resistor-string having a plurality of nodes between power supply terminals having a given voltage difference therebetween; a digital-to-analog converter (DAC) switch unit in which each of DAC switches is connected to each of the nodes in the resistor-string; a digital decoder for receiving the digital data and generating a signal that controls each of the switches; and a ramp switch unit in which each of ramp switches is connected to each of the nodes in the resistor-string.

Here, each of the DAC switches is an NMOS. In addition, the outputs of the digital decoder are connected to gates of the NMOS; each node in the resistor-string is connected to each source of the NMOS; and drains of the NMOS are connected each other. Meanwhile, each of the ramp switches is a MOS. Further, each ramp switch control signal is connected to each gate of the MOS; each node in the resistor-string is connected to each source of the MOS; and drains of the MOS are connected each other.

Another aspect of the present invention is to provide a driving method of a source for an active matrix EL display, comprising the steps of: receiving a main clock signal and generating an enable signal for sequentially storing a digital data; sequentially storing the digital data by the enable signal and outputting the stored digital data for one line at a time, in parallel; converting the outputted digital signal into an analog signal and generating a ramp signal, at the same time; and outputting the converted analog data and the ramp signal.

Here, the step of converting the digital signal to the analog signal is performed by using Binary-Weighted Resistor DAC, R-2R-Based DAC, Switch-Capacitor DAC, or Current-Mode DAC.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF PREFERRED EMBODIMENTS

Now, preferred embodiments of the present invention will be described in detail with reference to the accompanying drawings. The embodiments of the present invention are intended to more completely explain the present invention to those skilled in the art.

Hereinafter, a source driver circuit for an active matrix EL display according to the present invention will be explained with reference to FIG. 2.

Figure 1:
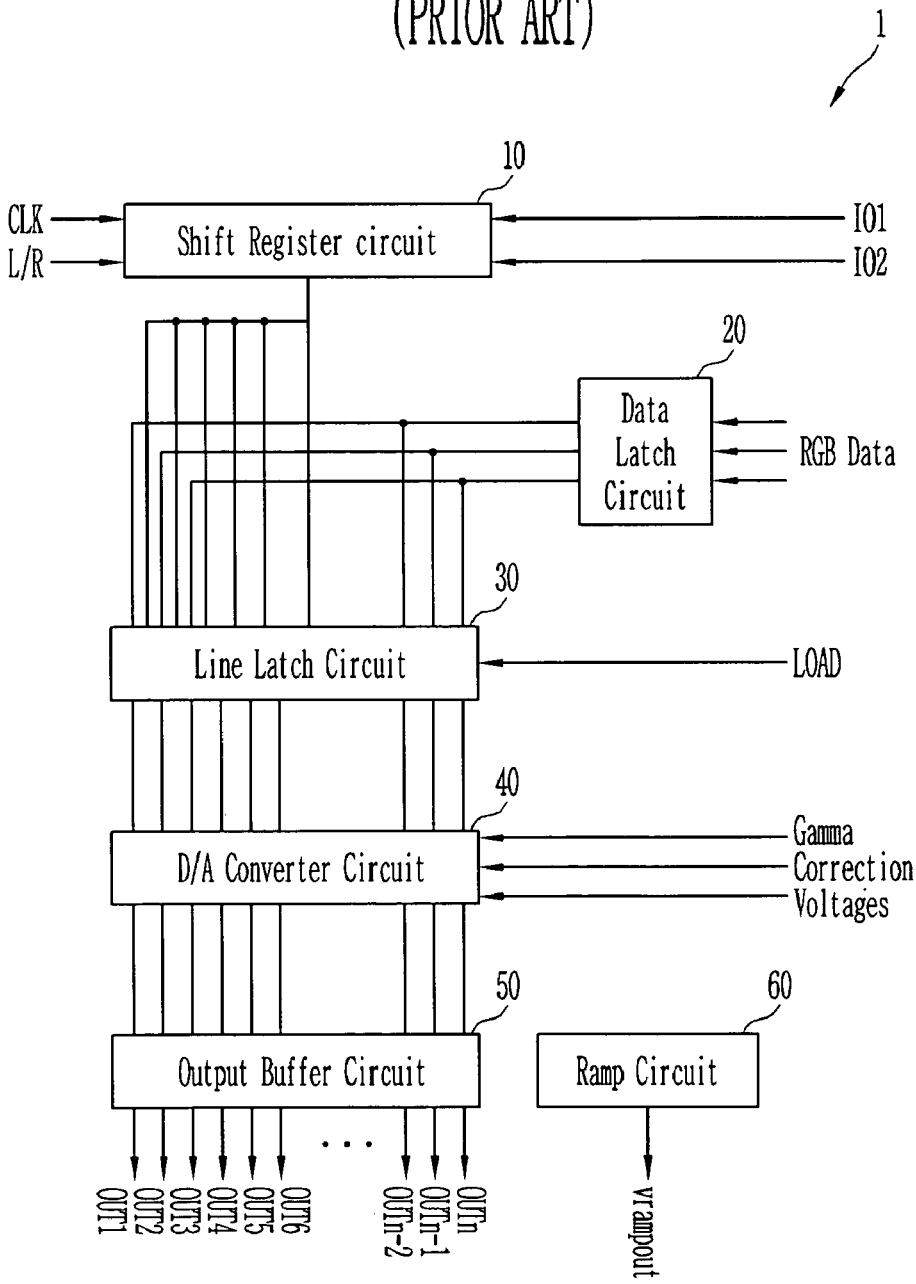
FIG. 1 (PRIOR ART)
FIG. 1 is a detailed block diagram of a source driver circuit for an active matrix EL display according to a prior art.
Figure 2:
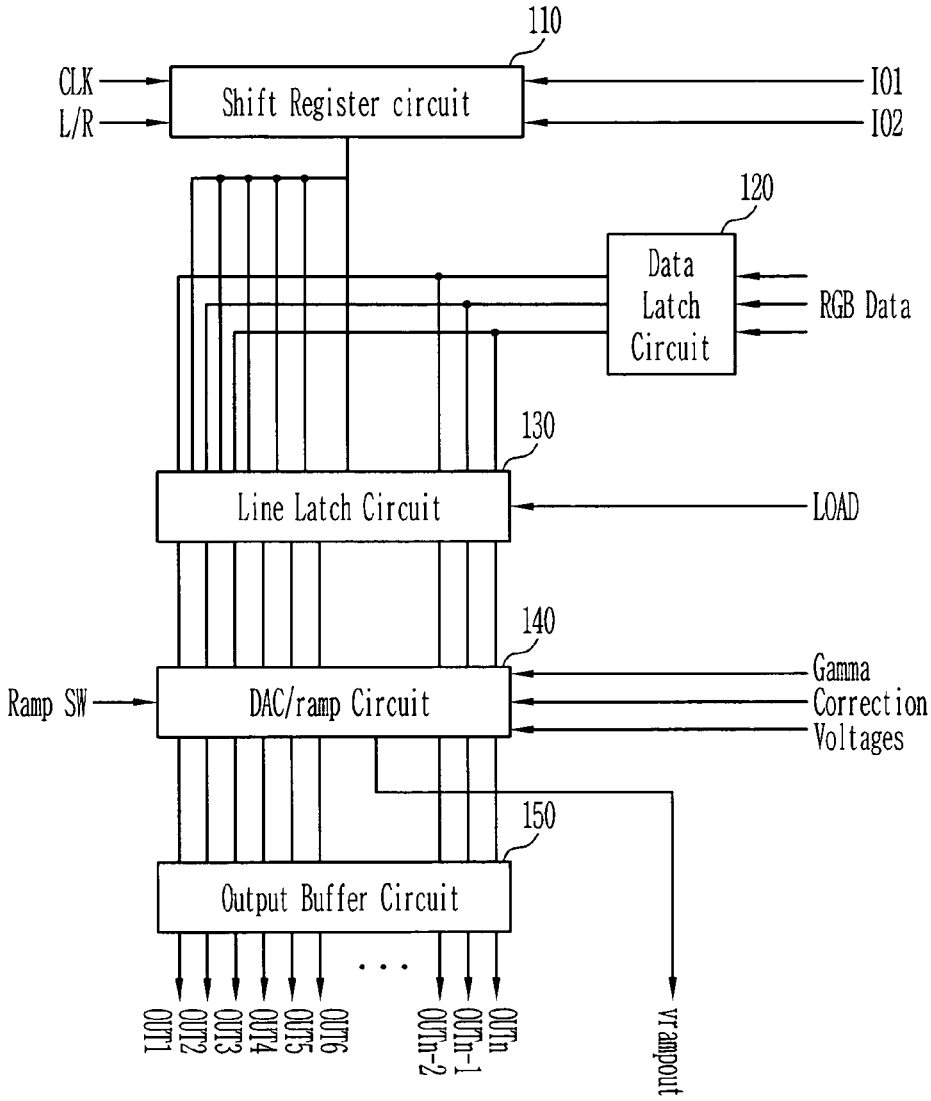
FIG. 2 is a detailed block diagram of a source driver circuit for an active matrix EL display according to the present invention.

FIG. 2 is a detailed block diagram of a source driver circuit for the active matrix EL display according to the present invention. The source driver circuit for an active matrix EL display comprises a shift register circuit 110, a data latch circuit 120, a line latch circuit 130, a digital-to-analog converter/ramp circuit (DAC/ramp circuit) 140, and an output buffer circuit 150.

External signals inputted to the source driver circuit for the active matrix EL display are as follows: an RGB (red-green-blue) data signal RGB Data inputted to the data latch circuit 120; a main clock signal CLK inputted to the shift register circuit 110, and a direction control signal L/R for determining the direction thereof; input start signals I01 and I02; a load signal LOAD inputted to the line latch circuit 130; a ramp switch signal Ramp SW inputted to the DAC/ramp circuit 140; gamma correction voltages; and so on. The load signal LOAD receives a new data and transfers the stored data, at the same time. The gamma correction voltages are signals for correcting the inorganic EL display characteristics in the outside. In the case of the output signals OUT1 to OUTn, final outputs are analog voltage signals. The ramp signal vrampout is a signal for achieving gray scale.

The shift register circuit 110 receives the main clock CLK signal and the L/R signal for determining the direction, and generates an enable signal for sequentially storing a data in the line latch circuit 130, and the line latch circuit 130 works as a latch for storing the data.

The line latch circuit 130 stores the data sequentially by the enable signal of the shift register circuit 110 for one line time, and then, transfers the data, which is stored by the LOAD signal, to the DAC/ramp circuit 140 in parallel, at a time. At this time, a new data is stored in the line latch circuit 130.

For achieving gray scale, the DAC/ramp circuit 140 converts a digital signal into an analog signal and generates the ramp signal vrampout. The DAC/ramp circuit 140 converts the inputted digital data to the corresponding analog voltage, and at the same time, generates a signal independent of a change of a temperature or a threshold voltage, by outputting the ramp signal vrampout. The analog signal is needed for representing gray scale. The digital-to-analog conversion in the DAC/ramp circuit may use a resistor-string (R-String) circuit, for example. The ramp signal vrampout is the reference voltage having the sawtooth waveform for implanting gray scale.

In the aforementioned DAC/ramp circuit, the R-String circuit was employed for conversion, as an example. However, the kind of the DAC/ramp circuit is not confined thereto and various types thereof may be made. For another example, there are Binary-Weighted Resistor DAC, R-2R-Based DAC, Switch-Capacitor DAC, Current-Mode DAC, etc. Therefore, the DAC/ramp circuit 140 that employs various kinds of the D/A converter circuit, as described above, may further comprise a D/A converter for converting the digital data to the analog data, and a ramp switch unit capable of controlling each node output thereof. In other words, by employing the DAC/ramp circuit 140 as mentioned above, it is possible to convert the digital data to the corresponding analog voltage, and to generate a signal independent of a change of a temperature or a threshold voltage by outputting the ramp signal vrampout.

The output buffer circuit 145 may be composed of a voltage followed type operational amplifier (OPAMP).

Figure 3:
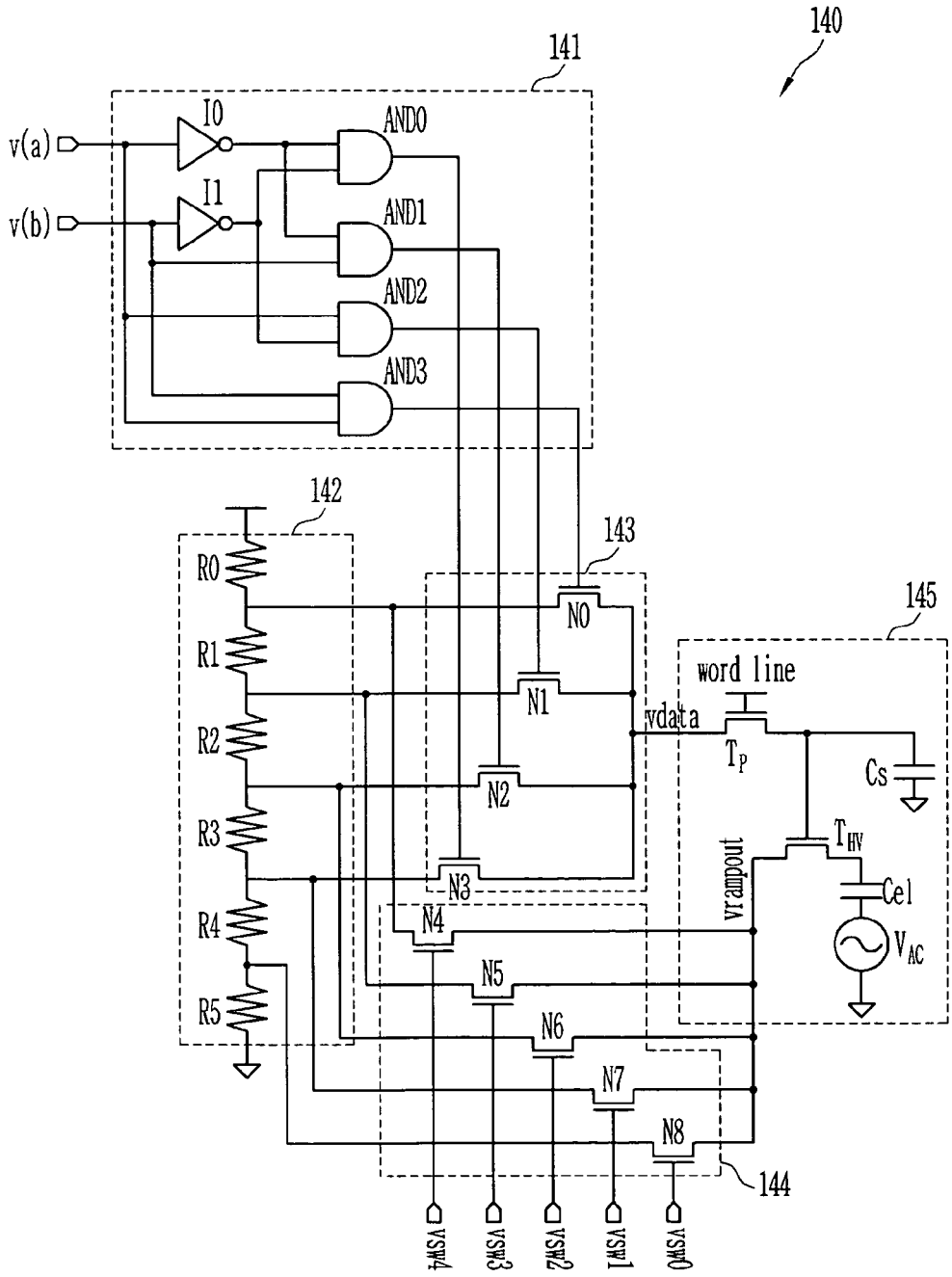
FIG. 3 is a detailed block diagram of a digital-to-analog converter/ramp circuit of FIG. 2.

FIG. 3 is a detailed block diagram of the DAC/ramp circuit of FIG. 2.

Referring to FIG. 3, the DAC/ramp circuit 140 comprises a digital-to-analog (D/A) converter units 141, 142, and 143, and a ramp circuit switch unit 144.

The D/A converter units 141, 142, and 143 may have a data decoder 141, a resistor-string (R-string) 142, and a DAC switch unit 143. For example, 2-bit input digital data (v(a), v(b)) is converted to the analog data by the data decoder 141 and the R-string 142, and the converted analog data passes through the DAC switch unit 143 to output a signal vdata.

Meanwhile, in the ramp circuit switching unit 144, switches N4 to N8 are connected to nodes of the R-string 142, respectively, and selectively opened/closed by using ramp switch control signals RampSW vsw0, vsw1, vsw2, vsw3, and vsw4, to generate the ramp signal vrampout. In other words, each of the output nodes in the R-string 142 is equipped to generate the ramp signal vrampout, and then, used as the reference voltage during the digital-to-analog conversion.

Figure 4:
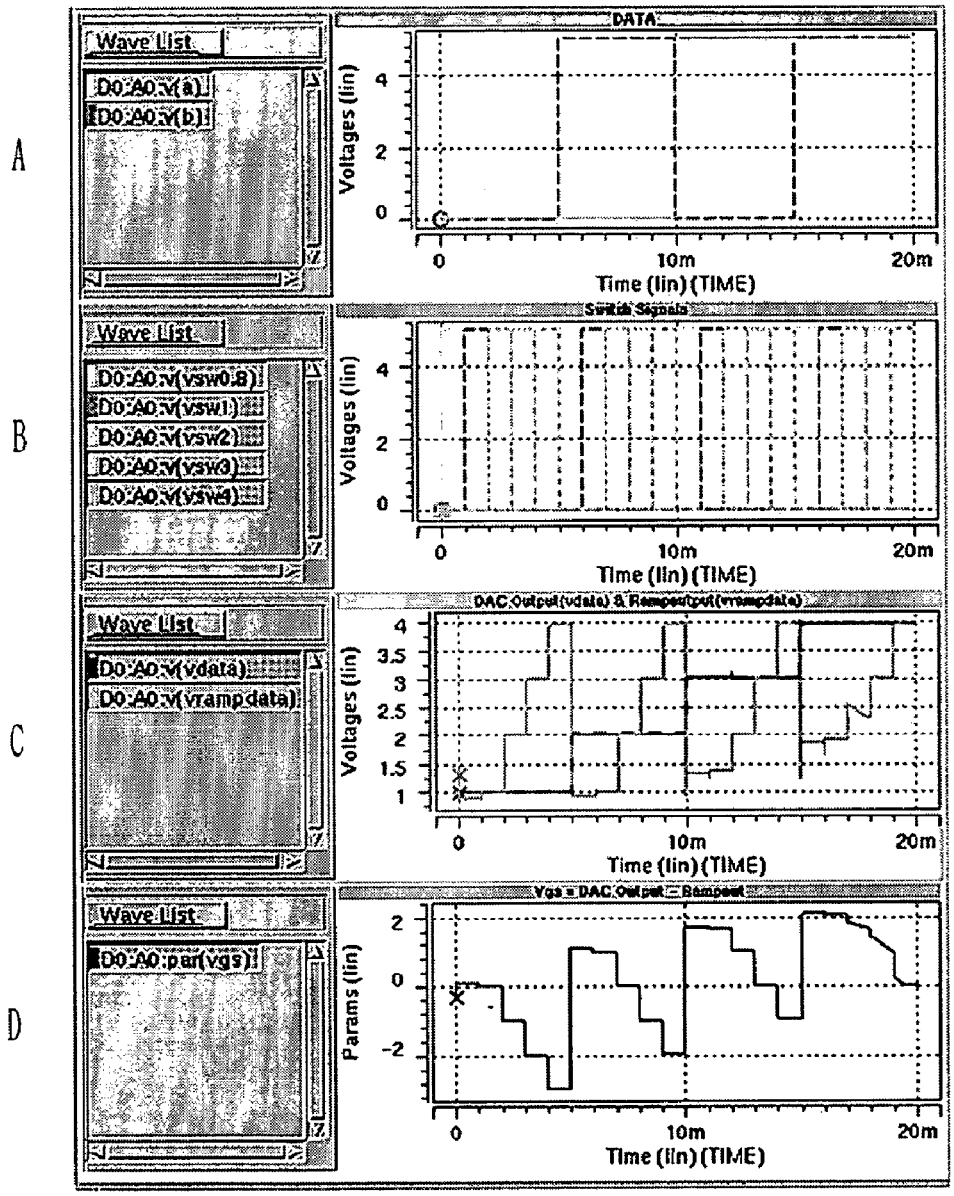
FIGS. 4A to 4D are simulation results of the digital-to-analog converter/ramp circuit of FIG. 2.

FIGS. 4A to 4D are simulation results of the DAC/ramp circuit of FIG. 2. FIG. 4A is a graph for showing 2-bit digital data of two inputs (v(a),v(b)) depending on time; FIG. 4B shows an example of a voltage level in the ramp switch control signals vsw0, vsw1, vsw2, vsw3, and vsw4; FIG. 4C is a graph for showing the ramp signal vrampout, in which the analog data vdata converted by the DAC/ramp circuit and the fabrication process thereof become one ouput; and FIG. 4D is a graph for showing a value, which is obtained by subtracting the ramp signal vrampout from the converted analog data vdata, and defined as Vgs.

Meanwhile, the analog data vdata is passed through the output buffer circuit 145 and stored in the storage capacitor (C.sub.S). By comparing the converted analog data with the ramp signal vrampout of the reference voltage, the inorganic EL display in a panel is emitted. As shown in FIG. 3, the analog data vdata is directly connected to the cell, but practically, it is connected to the cell after being passed through the output buffer circuit 145 and buffered.

Figure 5:
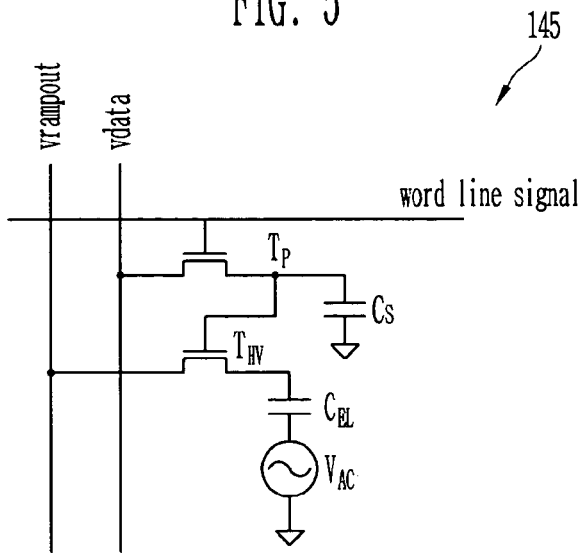
FIG. 5 is a pixel structure of an active matrix inorganic EL, according to a preferred embodiment of the present invention.
Figure 6:
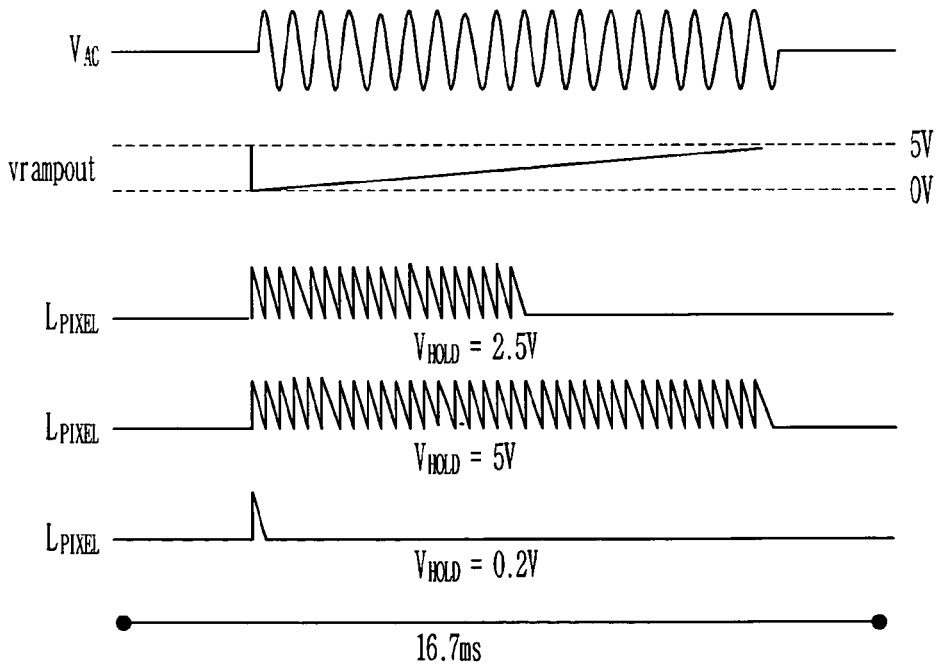
FIG. 6 is a graph showing a waveform of a voltage applied to the inorganic EL, according to a data stored in the pixel of FIG. 5.

FIG. 5 is a pixel structure of the active matrix inorganic EL, according to a preferred embodiment of the present invention, and FIG. 6 is a graph showing a waveform of a voltage applied to the inorganic EL, according to the data stored in the pixel of FIG. 5.

The active matrix inorganic EL pixel of FIG. 5 is composed of a pass transistor $T_P$ that operates at a low voltage, and a high voltage MOS($T_{HV}$). A drain of the pass transistor $T_P$ is connected to a gate of the high voltage MOS($T_{HV}$); a source of the pass transistor $T_P$ is connected to a data line to receive the signal vdata; and the gate is connected to a word line to receive a word line signal. In addition, the storage capacitor $C_s$ is connected to the gate of the high voltage MOS($T_{HV}$); a ramp line is connected to a source of the high voltage MOS ($T_{HV}$) to apply the ramp signal vrampout. Further, one terminal of an AC inorganic electroluminescent device (ELD) $C_{EL}$ is connected to the drain of the high voltage MOS($T_{HV}$), and the other terminal thereof is connected to an AC power supply $V_{AC}$ for operating the inorganic ELD.

The AC inorganic ELD is luminescent by an alternating current (AC) power supply. In other words, light is emitted in case that a plus (+) supply and a minus (−) power supply of a modulation voltage or more are applied to the device, alternatively. In contrast, there is no light emission in case that a direct current (DC) power supply or an alternating current (AC) power supply less than the modulation voltage is applied thereto. The modulation voltage depends on the characteristic of the inorganic ELD.

The principle of the operation is as follow. If the gate of the pass transistor $T_P$ becomes ON state, the analog data vdata is stored in the storage capacitor $C_S$ through the data line, thereby making the high voltage MOS($T_{HV}$) ON/OFF state. At this time, if the stored analog data vdata turns on the high voltage MOS($T_{HV}$), the voltage of the AC power supply, which is applied according to the voltage of the ramp line, is applied to the AC inorganic EL device, so that light is emitted. In case where the ramp line voltage is the same as the stored data, the high voltage MOS($T_{HV}$) becomes OFF state.

The high voltage MOS($T_{HV}$) is designed so that it becomes OFF state and the alternating current (AC) voltage less than the modulation voltage is applied to the inorganic ELD, whereby no light is emitted. The inorganic ELD is luminescent until the voltage of the ramp signal having the sawtooth waveform is equal to the stored date, and if they are equal, light emission stops. At this time, the high voltage MOS($T_{HV}$) acts as a comparator.

FIG. 6 is a graph showing a waveform of a voltage applied to the inorganic EL, according to the data stored in the pixel of FIG. 5. Referring to FIG. 6, if the stored data is 5 V, all the number of light pulses of the applied AC power supply are applied to the inorganic ELD; if it is 2.5 V, half of the number of light pulses are applied; and if it is 0.2 V, only one of the pulses is applied. Meanwhile, gray scale of the active matrix inorganic EL pixel is represented by means of pulse number modulation (PNM). In other words, gray scale is represented by the number of light pulses in the applied AC power supply.

According to the present invention, as described above, it is possible to reduce a power consumption and improve the degree of integration, by implanting the digital-to-analog converter and the ramp circuit having a simple structure, in which each node output of the source driver IC for the active matrix EL, particularly, the DAC circuit is used as the ramp circuit. In addition, the high performance gray scale can be realized by implanting the digital-to-analog converter and the ramp circuit independent of a change of a temperature or a threshold voltage.

Although the present invention have been described in detail with reference to preferred embodiments thereof, it is not limited to the above embodiments, and several modifications thereof may be made by those skilled in the art without departing from the technical spirit of the present invention.

The present application contains subject matter related to korean patent application no. 2003-96035, filed in the Korean Patent Office on Dec. 24, 2003, the entire contents of which being incorporated herein by reference.

What is claimed is:

1. A source driver circuit for an active matrix electroluminescent (EL) display, comprising:

a shift register circuit for receiving a main clock signal and generating an enable signal for sequentially storing a digital data;

a line latch circuit for sequentially storing the data by the enable signal, and outputting the stored digital data, in parallel;

a digital-to-analog converter/ramp circuit for converting the digital signal, which is outputted from the line latch circuit, to an analog signal, and at this time, generating a ramp signal, simultaneously, the digital-to-analog converter/ramp circuit further comprising:

a resistor-string comprising a plurality of nodes between power supply terminals, a given voltage difference existing therebetween;

a digital-to-analog converter (DAC) switch unit in which each of DAC switches is connected to each of the nodes in the resistor-string;

a digital decoder arranged to receive the digital data and generate a signal that controls each of the switches; and a ramp switch unit in which each of ramp switches is connected to each of the nodes in the resistor-string;

an output buffer circuit for inputting the converted analog data; and a ramp signal that is independent of a change of temperature or a threshold voltage;

wherein each of the ramp switches is a MOS device; and wherein each MOS device has its gate driven by a separate ramp switch control signal; each MOS device source input is connected to a different node of the resistor-string; and drains of the MOS device are connected together to generate the ramp signal.

2. The source driver circuit for an active matrix EL display as claimed in claim 1, wherein the digital-to-analog converter/ramp circuit comprises a digital-to-analog converter unit for converting a digital data into an analog data, and a ramp switch unit for controlling gray scaling.

3. The source driver circuit for an active matrix EL display as claimed in claim 2, wherein in the digital-to-analog converter/ramp circuit, Binary-Weighted Resistor DAC, R-2R-Based DAC, Switch-Capacitor DAC, or Current-Mode DAC is employed for a digital-to-analog conversion.

4. The source driver circuit for an active matrix EL display as claimed in claim 1, wherein each of the DAC switches is a CMOS.

5. The source driver circuit for an active matrix EL display as claimed in claim 4, wherein outputs of the digital decoder are connected to gates of the CMOS; each node in the resistor-string is connected to each source of the CMOS; and drains of the CMOS are connected each other.

6. A driving method of a source for an active matrix EL display, comprising the steps of:

receiving a main clock signal and generating an enable signal for sequentially storing a digital data;

sequentially storing the digital data by the enable signal and outputting the stored digital data in parallel;

converting the outputted digital signal into an analog signal using output nodes of a resistor string to generate a ramp signal to be used as a reference voltage during the digital to analog conversion; and outputting the converted analog data and the ramp signal;

wherein each output node of the resistor string is connected to a gate input of a separate MOS device and drains of the MOS device are connected together to generate the ramp signal; and wherein the generated ramp signal is independent of a change of temperature or a threshold voltage.

7. The driving method of a source for an active matrix EL display as claimed in claim 6, the step of converting the digital signal to the analog signal is performed by using Binary-Weighted Resistor DAC, R-2R-Based DAC, Switch-Capacitor DAC, or Current-Mode DAC.

* * * * *